US005453655A

United States Patent [19]

Helbig et al.

[11] Patent Number: 5,453,655

[45] Date of Patent: Sep. 26, 1995

[54] SINGLE-BASED INCADESCENT LAMP CONSTRUCTION

[75] Inventors: Peter Helbig; Ralf Hoffmann, both of Sontheim; Roland Stark, Wellheim, all of Germany

[73] Assignee: Patent-Treuhand-Gesellschaft F. Elektrische Gluehlampen mbH, Munich, Germany

[21] Appl. No.: 197,693

[22] Filed: Feb. 17, 1994

[30] Foreign Application Priority Data

Feb. 23, 1993 [DE] Germany ..... 43 05 503.6

[51] Int. Cl.[6] ..... H01K 1/46

[52] U.S. Cl. ..... 313/25; 313/578; 439/611; 439/615; 439/616

[58] Field of Search ..... 313/25, 49, 51, 313/318, 578, 579, 269, 292; 439/611, 613, 615, 616, 619, 602

[56] References Cited

U.S. PATENT DOCUMENTS

| | | | |
|---|---|---|---|
| 3,676,835 | 7/1972 | Holly | 313/318 |
| 4,569,005 | 2/1986 | Bergin et al. | 313/318 X |
| 5,043,624 | 8/1991 | Hirozumi et al. | 313/579 X |
| 5,053,935 | 10/1991 | Hellwig et al. | 313/318 X |
| 5,146,134 | 9/1992 | Stark et al. | 313/579 |
| 5,218,261 | 6/1993 | Stark | 313/25 |
| 5,229,683 | 7/1993 | Eckhardt et al. | 313/318 |
| 5,239,226 | 8/1993 | Seredich et al. | 313/318 |
| 5,281,889 | 1/1994 | Fields et al. | 313/318 X |

FOREIGN PATENT DOCUMENTS

| | | |
|---|---|---|
| 0435393A1 | 7/1991 | European Pat. Off. . |
| 1489414 | 3/1969 | Germany . |

*Primary Examiner*—Sandra L. O'Shea
*Assistant Examiner*—Ashok Patel
*Attorney, Agent, or Firm*—Frishauf, Holtz, Goodman, Langer & Chick

[57] ABSTRACT

To securely and reliably hold a high-voltage, for example service-line voltage (110 V, 220 V) halogen incandescent lamp within an outer envelope (2), and forming an electrical connection terminal to a screw-in, or straight-wall tubular base sleeve (3a, 43a) of a standard base, for example of the E14 or of the B22d type, a punched sheet-metal element (5, 5', 5", 25, 48, 48') is clamped around a projecting end portion (1a, 20a, 41a, 41a') of the halogen incandescent lamp; the projecting end portion, preferably, is a pinch seal, and the punched sheet-metal element is formed with a lower part and an upper part, in which the upper part clamps around or against the pinch seal. The lower part is partly located within the base sleeve and mechanically, and preferably electrically secured thereto. The pinch seal, preferably, is formed with a transversely extending rib, and the clamping portion is formed with a matching locating notch to ensure axial retention of the halogen lamp in the base. The base sleeve, at the same time, can form a seat for the outer envelope (2, 20, 42) and for laterally projecting tabs (11) projecting from the punched sheet-metal element to facilitate locating and retaining the halogen lamp on the base.

24 Claims, 10 Drawing Sheets

SINGLE-BASED INCADESCENT LAMP CONSTRUCTION

Reference to related patents, assigned to the assignee of the present application, the disclosures of which are hereby incorporated by reference:
U.S. 5,146,134, Stark et al
U.S. 5,218,261, Stark.
Reference to related publication:
European Published Application 0 435 393 A1, Damman et al.

FIELD OF THE INVENTION

The present invention relates to the internal construction of an incandescent lamp, and more particularly to the internal construction of a halogen incandescent lamp, in which the light emitting portion of the halogen incandescent lamp is retained in an inner light emitting bulb element, surrounded by an outer bulb which is supplied with a base adapted for insertion into a socket compatible with general service incandescent lamps. In particular, the invention is directed to the construction of a halogen incandescent lamp intended for replacement of ordinary general service incandescent lamps of network supply voltage, for example 110 V or 220 V, and insertion in standard general service lamp sockets.

BACKGROUND

U.S. Pat. No. 5,218,261, Stark, assigned to the assignee of the present application, the disclosure of which is hereby incorporated by reference, generally describes retention of a sealed light source element within a sealed outer bulb, furnished with a standard Edison E14 base, that is, with a screw-in base adapted to be received in a standard lamp socket. Connection of the electrical conductors supplying the sealed bulb element to the base is effected, for the external conductor, that is, for the screw-in terminal, by connecting one lead-in extending into the sealed element to a wire which is bent into essentially ring shape, and seated on a ring seating surface formed on a base sleeve which carries the screw-in portion of the base. This wire, typically a nickel-plated steel wire, is twisted into or connected to the interior of the outer threaded sleeve. One end is bent over and connected with the current supply lead from the sealed element, for example by welding.

The wire which is threaded into the interior of the sleeve not only provides electrical connection, but also has a holding or support function for the inner sealed light emitting element. It has been found in use that this support function may cause difficulties since forces are transferred to the pinch seal, customary in the light emitting sealed element. Vibration and shock which arise, primarily during transport, may lead to destruction of the weld between the current supply lead extending into a pinch seal formed in the inner bulb element, and a molybdenum foil sealed into the pinch seal.

European Published Application 0 435 393 A1, Damman et al, describes, a halogen incandescent lamp which is retained within a reflector supplied with a screw-in base. The halogen incandescent unit itself is held by a lamp carrier which clamps around a pinch seal of the halogen bulb. Extending flaps, tabs or tongues secure the clamping element on projections located in the neck portion of the reflector. Retaining the lamp carrier in the neck portion of the reflector increases the length of the overall lamp and, consequently, reflector lamps of this type cannot be used as direct replacements for ordinary incandescent lamps having standard screw-in sockets.

THE INVENTION

It is an object to provide a single-based electric lamp which includes a halogen lamp unit within an outer bulb, in which the outer bulb has a base compatible with standard lamp sockets, for example a screw-in or a tubular base, and in which the halogen lamp unit is retained within the outer bulb by a holding arrangement resistant to vibration and shock, and without applying any forces on the current connection leads from the halogen lamp unit.

Briefly, the retention structure for the halogen unit is a punched sheet-metal element clamped around a projecting end portion of the halogen lamp unit, which is mechanically and preferably also electrically secured a base sleeve forming part of the base. In Edison screw-in bases, in which the base sleeve is formed as a contact sleeve with a thread adapted to be threaded into the socket of a lamp, the punched sheet-metal element is directly secured to this threaded contact sleeve. The invention is equally applicable to smooth base sleeves, e.g. bayonet-type bases.

The arrangement permits retention of the halogen lamp unit within the outer envelope by a lamp carrier which is sturdy, made of punched sheet-metal, and which clamps around the halogen lamp unit, thus removing any stresses from the connection leads to the halogen lamp unit. The punched sheet-metal element, by being secured directly to and located preferably partly within the sleeve of the base, substantially reduces the axial length of the overall holding structure, and hence of the lamp, to permit direct replacement of the halogen lamp for an ordinary type incandescent lamp, for example of the screw-in base type. The arrangement in which the punched sheet-metal element surrounds the halogen lamp unit provides retention of the lamp unit within the outer envelope which is reliable and secure even if the lamp is subjected to shocks or vibration. The current supply leads themselves are not subject to any stresses upon shocks or vibration. Attaching the lamp carrier within the base sleeve permits constructing the lamp with a relatively short length, comparable roughly to that of the general service lamps, so that the lamps with the halogen incandescent lamp unit therein can be made as a direct replacement for general service lamps in which a filament is enclosed within a single bulb. The light output of the halogen incandescent lamp, with equal energy consumption, is substantially higher than that of non-halogen incandescent general service lamps.

In accordance with a preferred feature of the invention, the halogen lamp unit is retained within the outer bulb in the sheet-metal holder by clamping the sheet-metal holder to a pinch seal of the halogen lamp unit. The region of the pinch seal is not a significant region of light output of the lamp unit. Mechanical attachment in this region is simple. The upper portion of the lamp carrier, which is adjacent the bulbous portion of the halogen unit, is formed with a plurality of flaps or attachment tabs or holding pincers, which clampingly surround the pinch seal of the halogen lamp unit. Preferably, the flaps, tabs or holding pincers are formed with notches or recesses which interengage with projections, e.g. ribs or the like formed on the pinch seal. This ensures excellent retention of the halogen bulb unit in the carrier structure.

The lower portion of the carrier structure is of tubular shape and engages into the base, typically a screw-in base, that is, against the inner wall of the base sleeve. This ensures tight seating of the lamp carrier in the base sleeve as well as axial alignment of the halogen lamp unit within the outer bulb. Preferably, the lower portion of the lamp carrier is welded to the base sleeve or formed with another attachment arrangement which for example permits the lamp carrier to be screwed into the inner thread of the base sleeve. Such attachment arrangements are preferably constructed in the form of spaced projections or tabs which are deformed from the lower portion of the lamp carrier and are so shaped that they can be threaded into the inner thread of the base sleeve, and then grip the inner surface of the sleeve while opposing any attempt to unscrew them so that they, simultaneously, form a reliable one-way thread arrangement. Such projections or tabs can also be formed as barbs and, preferably, have a sharp edge which can bite into the inner surface of the wall of the base sleeve.

In accordance with a preferred feature of the invention, the lamp carrier is formed with at least one angled-off tab which, upon introduction of the lower part of the holder into the base sleeve, forms a stop element to positively define the relative position of the halogen lamp unit within the base sleeve, and hence within the outer bulb.

DRAWINGS

FIG. 1 is a highly schematic side view, partly in section, of a tubular, multi-filament lamp in accordance with the present invention;

FIG. 1*a* is a view similar to FIG. 1 and showing a modification;

FIG. 2*a* is a plan view of one embodiment of the halogen lamp unit carrier as stamped, and before being bent to hold a lamp unit;

FIG. 2*b* is a fragmentary representation of the lower portion of the lamp carrier illustrated in FIG. 2*a* and showing, especially, the retention thereof within a base sleeve of a lamp;

FIG. 2*c* is a cross section along line A—A of FIG. 1 through the upper portion of the lamp carrier illustrated in FIG. 2*a* and showing the attachment on the pinch seal of the halogen lamp unit, in which the outer bulb and any elements not necessary for an understanding of the attachment have been omitted;

FIG. 3*a* is a view similar to FIG. 2*a*, but illustrating another embodiment;

FIG. 3*b* is a view similar to FIG. 2*b* of the lamp carrier of FIG. 3*a;*

FIG. 4*a* is a view similar to FIG. 2*a* of yet another embodiment;

FIG. 4*b* is a view similar to FIG. 2*c* of the lamp carrier of FIG. 4*a;*

FIG. 5 is a side view, partly in section, of another type of lamp, in which a halogen lamp unit is retained within an outer bulb;

FIG. 6*a* is a view similar to FIG. 2*a* of the lamp carrier used in the embodiment of FIG. 5;

FIG. 6*b* is a view similar to FIG. 2*c* of the lamp carrier of FIG. 6*a;*

FIG. 7 is a highly schematic side view, partly in section, of a multi-filament lamp having a base with a smooth outside;

FIG. 8*a* is a view of a lamp generally similar to that of FIG. 7, but having a screw-in base; and FIG. 8*b* is a plan view of the lamp carrier used in the lamp of FIG. 8*a*, before being bent to retain the halogen incandescent lamp unit.

DETAILED DESCRIPTION

Figure 1:
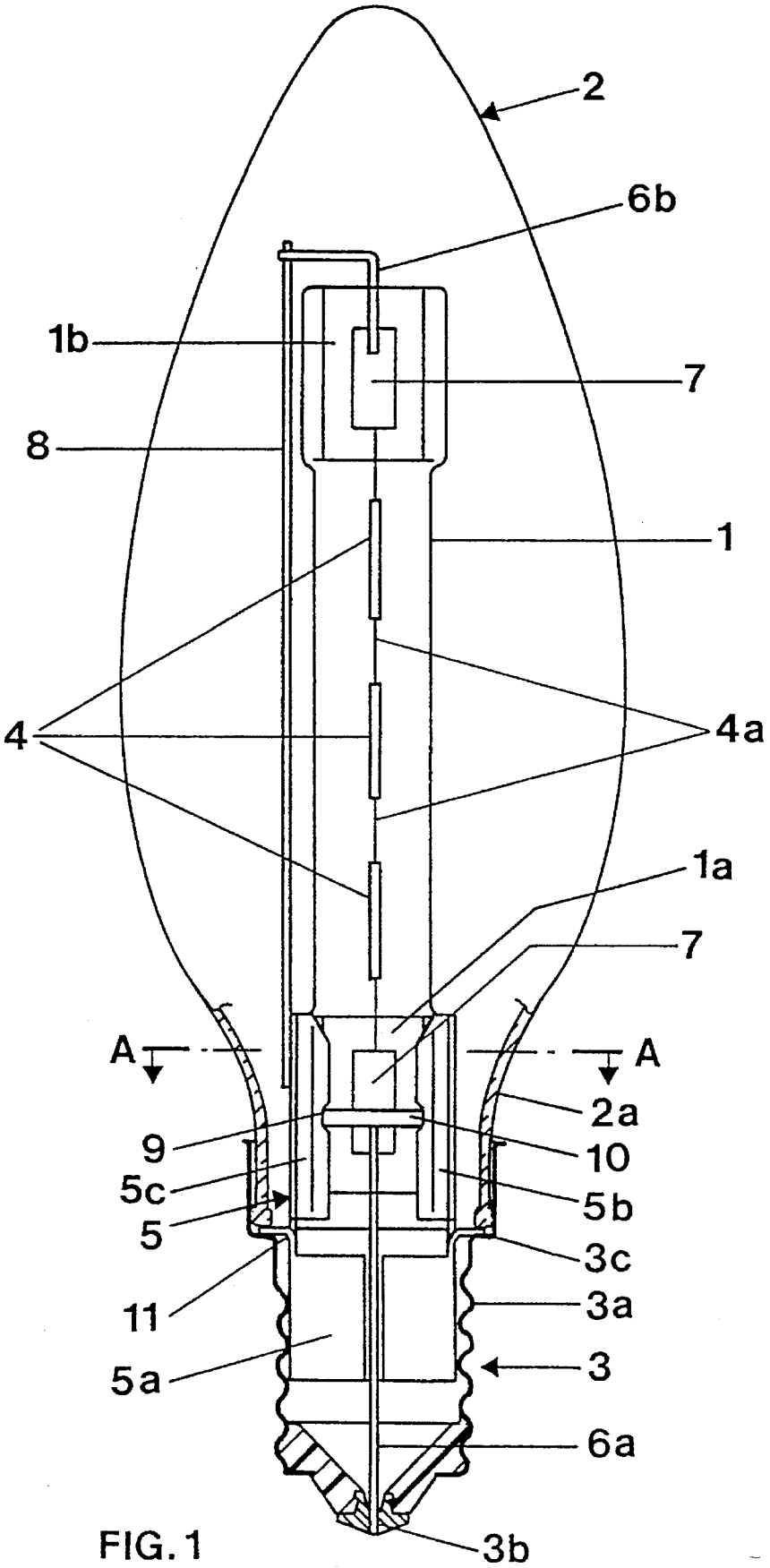

Referring first to FIG. 1, which illustrates a first embodiment of an electric lamp in accordance with the present invention.

The lamp has a high-voltage halogen incandescent lamp unit which has a lamp bulb or lamp cylinder 1 made of quartz glass. The halogen lamp unit is located within a light-transmissive outer envelope or outer bulb 2. The outer bulb 2 has an open neck region 2*a* which is secured in a metallic base sleeve 3*a* of a base 3. The base 3 is illustrated in this example as a standard screw-in base of the Edison type E14. The neck region is secured to the base sleeve by a suitable cement, as well known.

The incandescent lamp bulb or inner bulb 1 is, as illustrated, of the tubular lamp type. In such a lamp, the bulb is an elongated cylinder having two gas-tightly closed ends 1*a*, 1*b*, formed by pinch seals, which retain between themselves a light-emitting filament having a plurality of axially located, coiled incandescent filament portions 4, connected together by straight portions 4*a*. Preferably, the glass of cylinder 1 is pinched against portions 4*a*, as explained in detail in the referenced U.S. Pat. No. 5,146,134, Stark et al. The figures do not show the pinch regions, for clarity of the drawing. Both of the pinch ends or pinch seals 1*a*, 1*b* have a profile which is somewhat double T or I-shaped, in which the cross elements of the T or I, respectively, are short and project only slightly from the otherwise essentially flat pinch ends or pinch seals 1*a*, 1*b*, respectively.

The inner lamp cylinder or inner bulb 1 of the halogen incandescent lamp unit is retained in axial position within the outer bulb 2 by a carrier 5. The inner bulb 1, thus, defines a proximate end 1*a* and a distal end 1*b*, with respect to the base 3. Current supply leads 6*a*, 6*b* extend from the respective pinch ends 1*a*, 1*b*. The current supply leads 6*a*, 6*b* are electrically connected to the incandescent filament elements 4 by molybdenum foils 7, sealed into the pinch ends 1*a*, 1*b*. The proximate current supply lead 6*a* forms an electrical connection between the adjacent incandescent filament portion 4 and the base terminal 3*b* of the screw-in base 3. The distal current supply lead 6*b* is connected to a return conductor 8 secured to the lamp support 5 which forms an electrical connection between the incandescent elements 4 and the base sleeve 3*a*. The return line 8 is welded to an angled-off end of the distal current supply 6*b* and, further, is welded to the lamp support 5. A portion of the return line 8 can be formed as a melt fuse.

In accordance with a feature of the invention, the lamp support or lamp retention element 5 is a punched sheet-metal single element, preferably made of nickel-coated sheet steel, for example HILUMIN (®) of about 0.4 mm thickness.

Figure 2A:
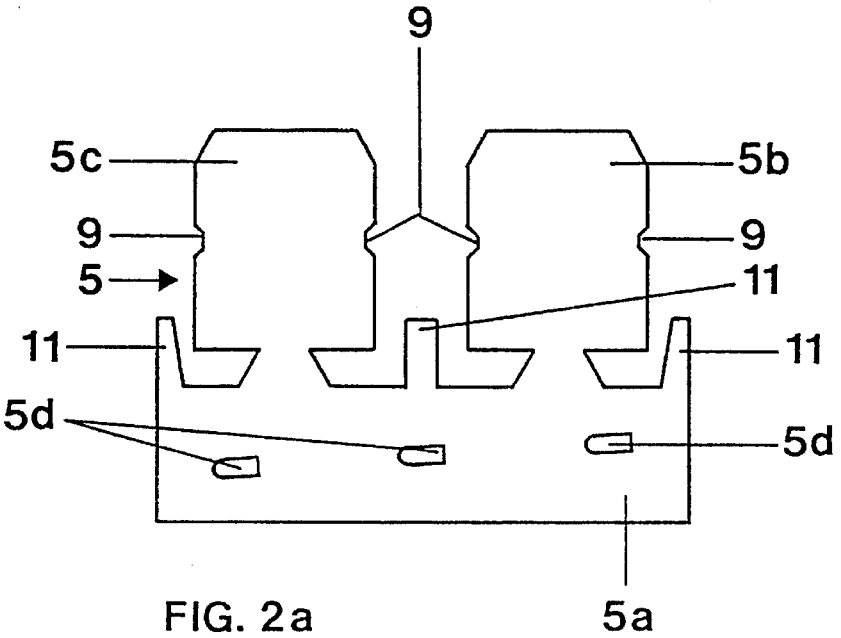
Figure 2B:
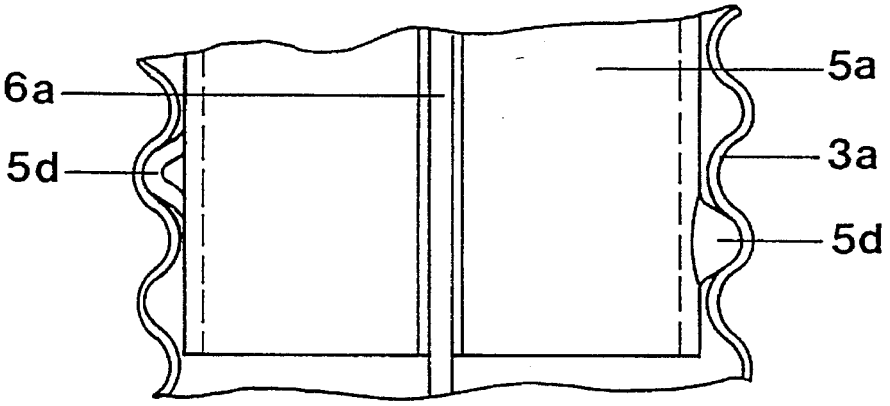
Figure 2C:
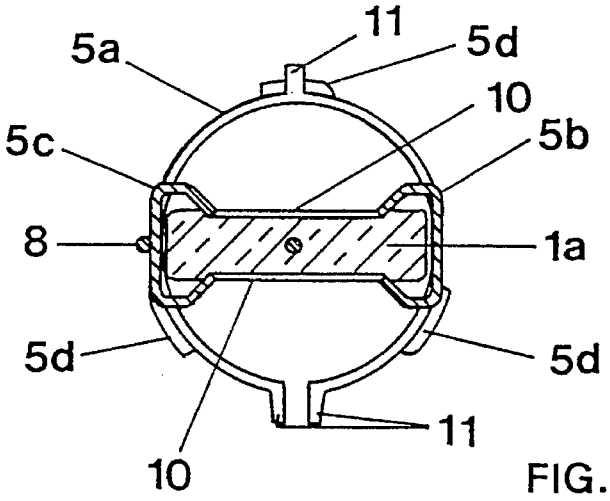

FIG. 2*a* illustrates, to an enlarged scale, the lamp retention element 5 immediately after punching from a strip of sheet metal, and before the punched element is shaped to form the retention structure. The lamp retention or support element 5 is formed to have a tubular, typically circular tubular lower part 5*a* which, after assembly, is entirely located within the interior of the base 3, and which engages the inner wall of the base sleeve 3*a*. The upper portion of the lamp support element 5 is formed by two holding jaws 5*b*, 5*c* which are integral with the lower part 5*a* and, when the holding element 5 is formed, clampingly surround the narrow end sides of the proximate pinch end 1*a* of the halogen incandescent inner bulb 1, as best seen in FIG. 2*c*.

The holding jaws 5*b*, 5*c* are formed with two notches 9 at their outer edges. These notches 9 engage with transversely extending ribs 10 formed in the pinch seal 1*a*. The rib or ribs 10 extend transversely to the axis of the lamp. Interengagement of the notches 9 with the rib or ribs 10 ensures axial retention of the pinch seal la between the holding jaws 5*b*, 5*c* in axially predetermined position.

In accordance with a feature of the invention, three projections 5*d*, for example punched tips or bumps or cut tabs, are formed at the outer wall of the lower portion 5*a* of the lamp support unit 5. The location of these projections 5*d* is determined by the pitch of the E14 screw thread; the projections form an interrupted thread flank to permit screwing of the lamp support unit 5 into the base sleeve 3*a*, as best seen in FIG. 2*b*. Preferably, the projections 5*d* are somewhat rounded in the direction of screw-in into the base sleeve 3*a*; in the opposite direction, however, they are terminated in sharp edges to prevent screwing out of the lamp carrier 5 from the base sleeve 3*a*.

In accordance with another feature of the invention, the lower portion 5*a* is formed with three bent-over tabs 11 which, after screwing the lamp support element 5 into the base sleeve 3*a*, engage on an abutment or step 3*c* of the base sleeve 3*a*. Together with the abutment 3*c*, these bent-over tabs 11 form a depth stop to determine the vertical position of the halogen unit retained in the support element 5 within the outer bulb 2.

The abutment 3*c* in the interior of the base sleeve 3*a* not only forms a stop and axial positioning gauge for the lamp carrier 5 but, further, forms a seat and stop for the neck region 2*a* of the outer bulb 2, which is cemented into the base sleeve 3*a*. The dimensions of the outer bulb 2 correspond roughly to the dimensions of a general service lamp supplied with an E14 screw-in base.

Figure 1A:
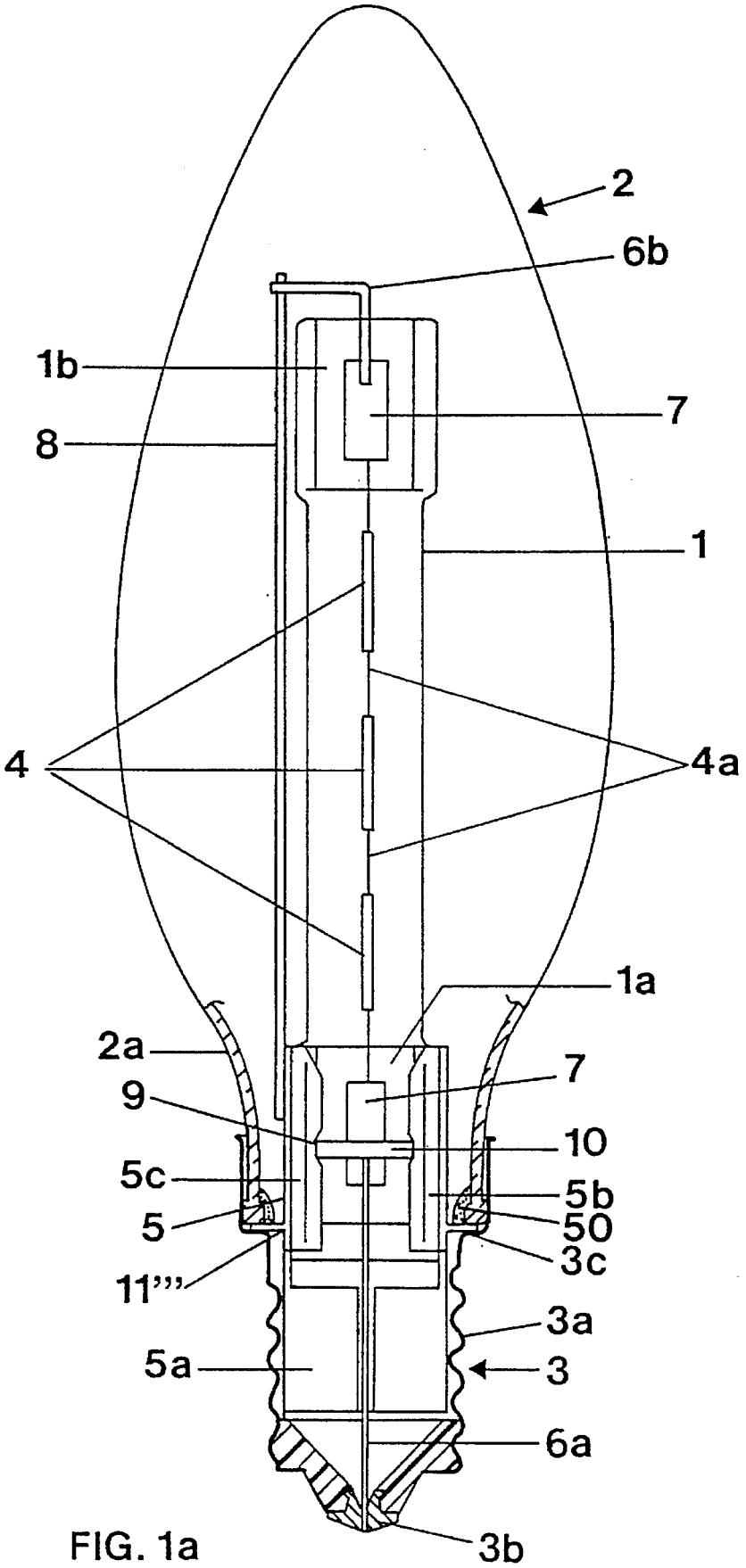

FIG. 1*a* shows a lamp which is identical to that illustrated in FIG. 1, except that the tabs 11 of FIG. 1 are extended and sturdy, to provide additional support and strength to the lamp support unit 5. These tabs shown at 11''' can be secured to the abutment or step 3*c* of the base sleeve, for example by a spot weld or the like. FIG. 1*a*, also, shows a cement connection 50 to cement the neck portion 2*a* of the outer bulb 2 on the extending bent-over tab 11''', to provide a solid, sturdy interconnection between the lamp carrier 5, the base 3 and the outer bulb 2. Preferably, the tabs 11''' are punched out from the holding jaws 5*b*, 5*c*, rather than as extensions 11 shown in FIG. 2*a*, to provide lateral support to the holding jaws 5*b*, 5*c* and hence a sturdy gripping connection with the pinch seal la of the halogen incandescent unit, inhibiting any lateral deflections of the holding jaws 5*b*, 5*c*. The support unit 5 then will be seated somewhat more deeply in the base 3—compare FIGS. 1 and 1*a*.

Figure 3A:
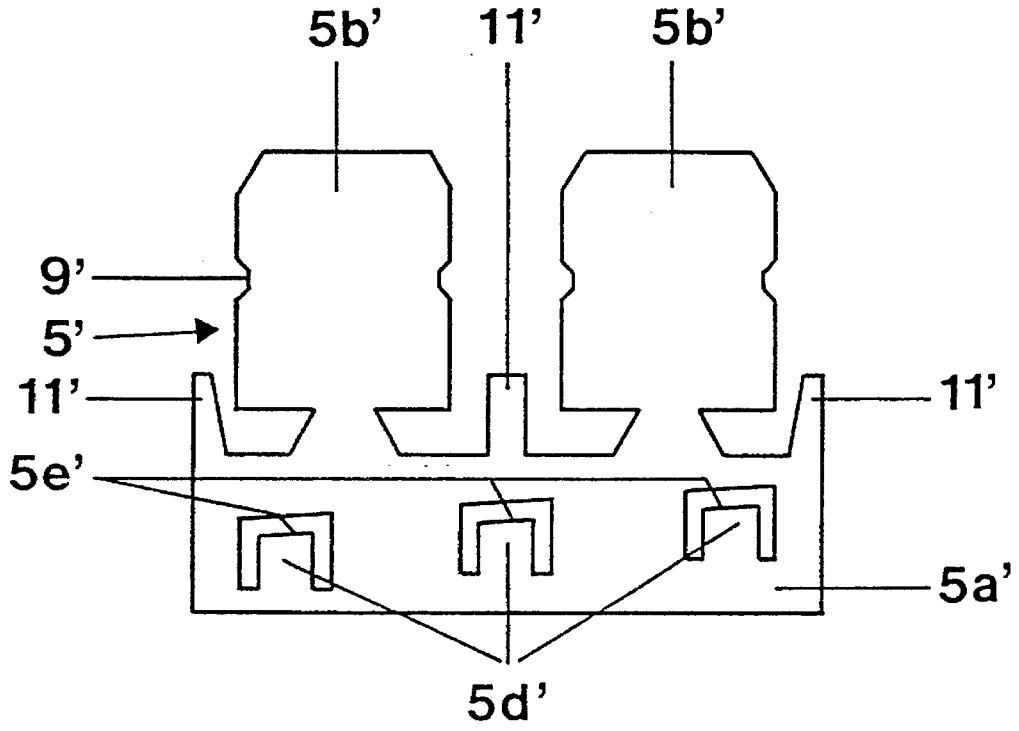
Figure 3B:
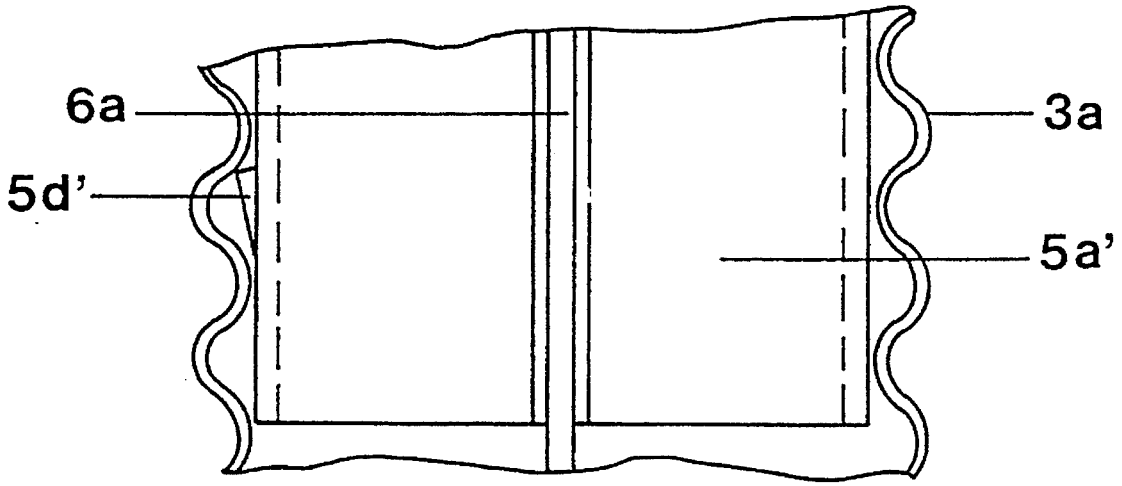

A second embodiment of the holding element of the lamp, in accordance with the present invention differs from that above described only by a detail of the lamp support element 5', as best seen in FIGS. 3*a* and 3*b*. The lamp support element 5' of the second embodiment has three tabs or tongues 5*d'* formed on the lower portion, rather than tips or projections. The tabs 5*d'* are formed on the tubular lower portion 5*a'* of the carrier 5' and are spread radially outwardly. The position of the three tabs 5*d'* is similar to that of the projections 5*d* (FIG. 2*b*), that is, at an inclination corresponding to a flank of the thread, the pitch of which is matched to that of an E14 thread of the base sleeve 3*a*. The tubular lower portion 5*a'* of the lamp carrier 5' can be inserted into an E14 screw base 3 and, upon rotation by about 90° secured within a thread portion of the base sleeve 3*a*. The free ends 5*e'* of the tabs 5*d'* have an upwardly directed edge when the lamp, as seen in FIG. 1, is located with the screw base 3 at the bottom Upon rotating the retention unit 5' the sharp edges of the ends 5*e'* of the tabs 5*d'*which are inclined in the direction of screwing-in, will engage in barb-like manner in the thread at the inner wall of the base sleeve 3*a*, so that removal by rotating the support element 5' in screwing-out direction is effectively prevented. FIG. 3*b* clearly shows the engagement of the tab 5*d'* against the inner wall of the screw-in sleeve 3*a*.

The second embodiment, in all other respects, is identical to that described in connection with FIG. 1. As seen in FIG. 3*a*, the lamp carrier or support 5' has two holding jaws 5*b'* formed with notches 9', and the tabs 11', which are then turned over, and project from the lower part 5*a'*. The function of the tabs is identical to that previously described.

Figure 4A:
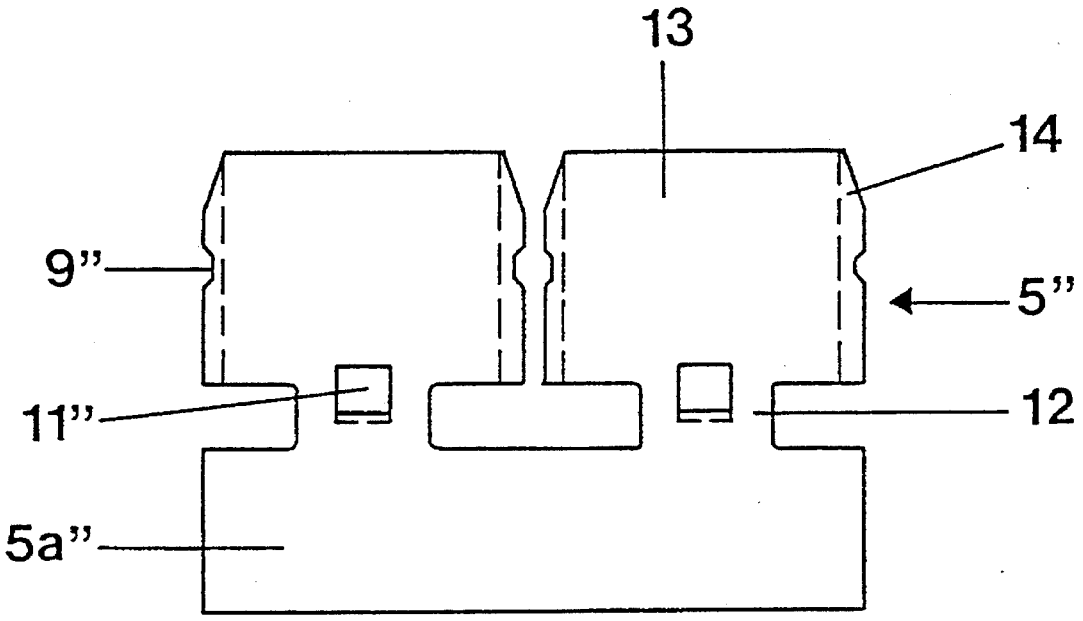
Figure 4B:
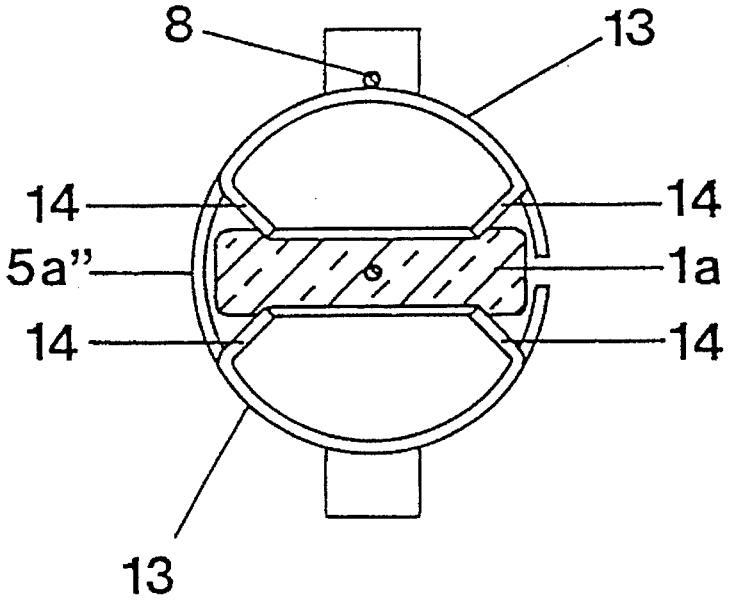

A third embodiment of the holding element of the lamp is illustrated in FIGS. 4*a* and 4*b*. Basically, the lamp is identical to that described in connection with FIG. 1; the difference is only in the form of the punched-out lamp carrier or retention element 5", before it is finally shaped Referring now to FIG. 4*a*: The lamp support or retention element 5" is formed of a punched sheet-metal element which has a lower part or portion 5*a"*, which is shaped in tubular form, for example part-circular cylindrical. After assembly into the base sleeve 3*a* of the base 3, it is fitted therein and engages the inner wall of the base sleeve.

Two projecting aprons 13 are connected by connecting strips 12, respectively, with the lower portion 5*a"* of the holding element 5". Each one of the aprons 13 forms an essentially circular cylindrical segment, the diameter of which corresponds to the diameter of the tubular lower portion 5*a"*. After assembly of the lamp carrier 5", the aprons 13 are located opposite the broader side of the proximate pinch seal 1*a*. The two aprons 13 are formed, each, with two inwardly directed attachment flaps 14, between which the proximate pinch seal end 1*a* of the high-voltage halogen incandescent lamp is held in clamped condition. The attachment flaps 14 engage against the broad sides of the proximate pinch seal 1*a* and, each, are formed with a notch 9" which fits over the rib or ribs 10, which extend transversely to the axis of the lamp at the pinch seal la of the lamp. Two outwardly directed tabs 11" are secured or formed on the lamp retention element 5", located generally at the level of the connecting strips 12. The tabs 11" after assembly, engage on the shoulder or seat 3*c* of the base sleeve 3*a*, and form a depth stop for the lamp carrier 5". Preferably, the tabs 11' are welded to the base sleeve 3*a*, preferably to the seat 3*c* of the base sleeve 3, after the lamp carrier 5", together with the halogen lamp, has been seated in the base. The return lead 8 from the distal current connection 6*b* is welded to one of the two aprons 13 to form a continuous electrical path between the distal current supply 6*b* and the base sleeve 3*a*.

Figure 5:
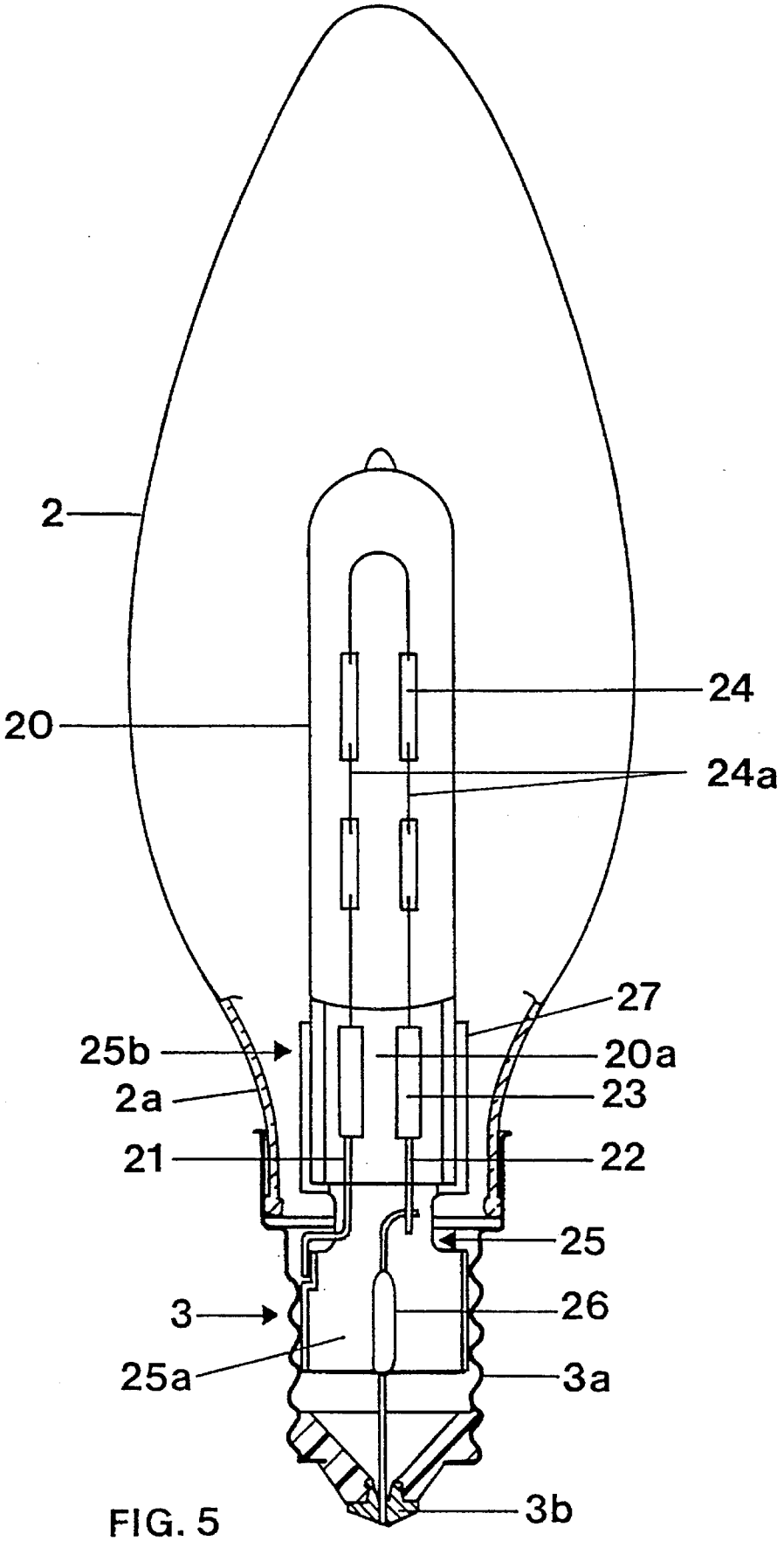
Figure 6A:
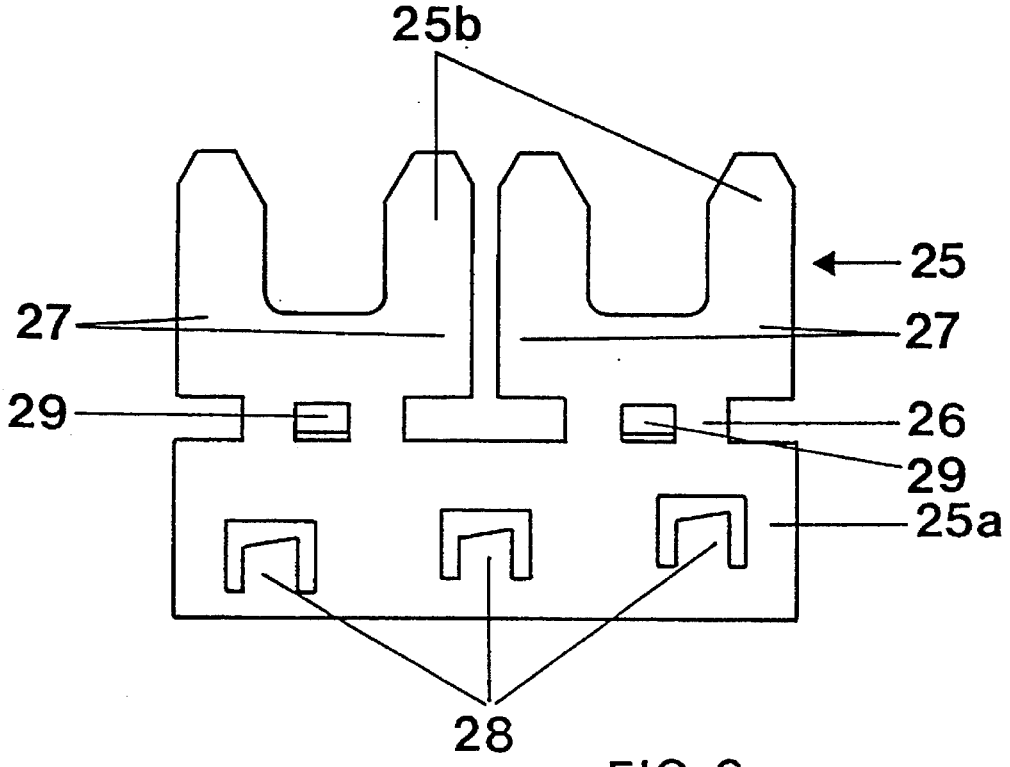
Figure 6B:
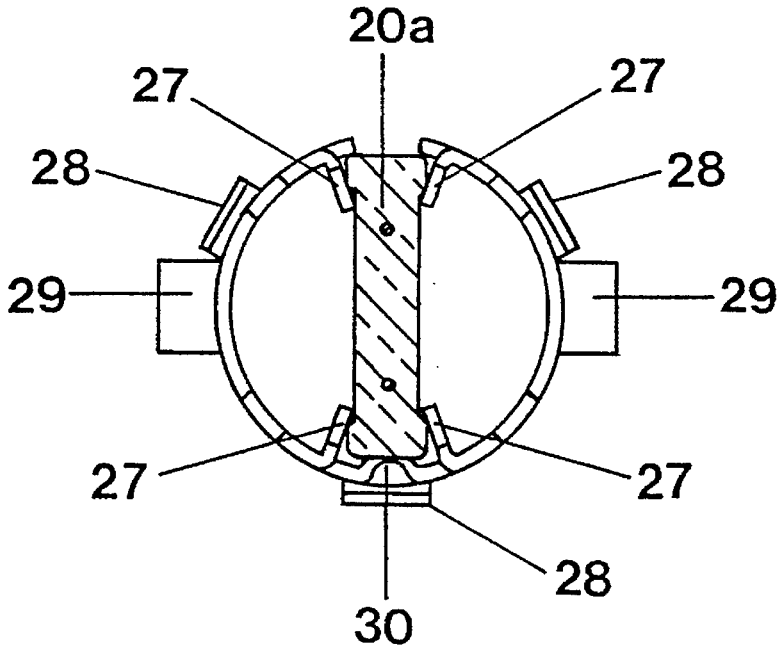

FIGS. 5, 6*a* and 6*b* illustrate a fourth embodiment of the lamp in accordance with the present invention. The basic difference between the fourth embodiment and the first, second and third embodiments is the shape of the type of halogen incandescent lamp which is used.

Referring to FIG. 5, the halogen incandescent lamp has a single-pinched, single-ended inner bulb 20, of quartz glass, terminating in a single pinch seal 20*a*. Two current supply leads 21, 22 extend from the pinch seal 20*a*, each of which is connected via molybdenum foil 23, melt-sealed into the pinch seal 20*a*, respectively, to the incandescent filament unit of the halogen incandescent lamp and to the base. The halogen incandescent lamp is formed of a plurality of incandescent portions 24 and connecting portions 24*a*, 24*b*, which are electrically connected together and suitably maintained in position, for example as described in the Stark et al U.S. Pat. No. 5,146,134. The pinch seal 20*a* has a slightly double T or I-shaped profile.

In accordance with a feature of the invention, the halogen incandescent lamp is held in position on the base by a unitary single-element lamp retention element or lamp carrier 25 which clamps around the pinch seal 20*a* of the inner lamp bulb 20, and is secured in the base sleeve, retained in axial position within the outer bulb 2. The outer bulb 2, as previously explained, has a neck portion 2*a* which is fitted into a metallic base sleeve 3*a* of an E14 screw-in base 3, for example by a suitable cement. The screw-in base 3 and the outer bulb 2 of this embodiment correspond to those previously described and the same reference numerals have been given to similar elements.

A first current supply lead 21 has a bent-over end which is welded to the lamp carrier 25 to form an electrical contact and terminal with respect to the base sleeve 3*a*. The other current supply lead 22 is connected, through a melt fuse 26, electrically conductively with the center or bottom terminal 3*b* of the screw-in base 3.

The lamp carrier or retention element 25 of the fourth embodiment in accordance with the present invention is best seen in FIGS. 6*a* and 6*b*. The lamp carrier 25, again, is a punched sheet-metal element made of nickel-plated sheet steel, such a HILUMIN (®). The lamp carrier 25 is illustrated in FIG. 6*a* before it is formed in an actual retention element, that is, as it appears after being punched from a strip of sheet steel. The lamp carrier 25 has a lower portion 25*a* which is bent into tubular or at least part-circular cylindrical shape and which, after assembly in the screw-in base 3, engages against the inner wall of the base sleeve 3*a*. Two aprons 25*b* extend from the lower portion 25*a*, connected thereto by a unitary connecting strip 26. The aprons 25*b* form, each, a circular ring segment, the diameter of which corresponds to the tubular lower portion 25*a*. Outer end portions of aprons 25*b* are bent as seen in FIG. 6*b* to form inwardly directed attachment tabs 27 to hold the pinch seal 20*a* of the halogen incandescent lamp in securely clamped engagement.

The lower portion 25*a* of the support element 25 has three radially outwardly spread apart tabs 28 located along the flank of inclination of the thread of the screw-in sleeve 3*a*. The free ends of the tabs 28 extend upwardly when the lamp, as shown in FIG. 5, has its base 3 at the bottom. The tongues 28 form an interrupted flank of a thread which permits screwing-in of the lamp carrier 25 into the base sleeve 3*a*. As described in connection with the second embodiment (FIGS. 3*a*, 3*b*), the lower portion 25*a* of the lamp carrier 25 is inserted into the base 3 and, after rotation by about 90°, secured in the inwardly extending thread of the base sleeve 3*a*. Upon rotation, the free ends of the tabs 28 engage against the inner walls of the base sleeve 3*a*, thus effectively preventing removal by attempting to rotate the holding element in reverse direction. The tabs 28 have sharp free ends and are inclined in the direction of rotation to permit their screwing-in, but preventing removal. The angle of inclination is larger than the angle of inclination of a flank of the thread.

Two bent-over outwardly directed tabs 29 are provided at about the level of the connecting portions 26 of the lamp retention element 25, for engagement with the shoulder 3*c* of the base sleeve 3*a*, after assembly of the halogen incandescent lamp with the base 3. The lower portion 25*a*, additionally, is formed with an inwardly directed groove or depression 30 to permit embedding the current supply lead 21, extending from the halogen incandescent lamp, and welding of the lead 21 to the lamp carrier 25.

Figure 7:
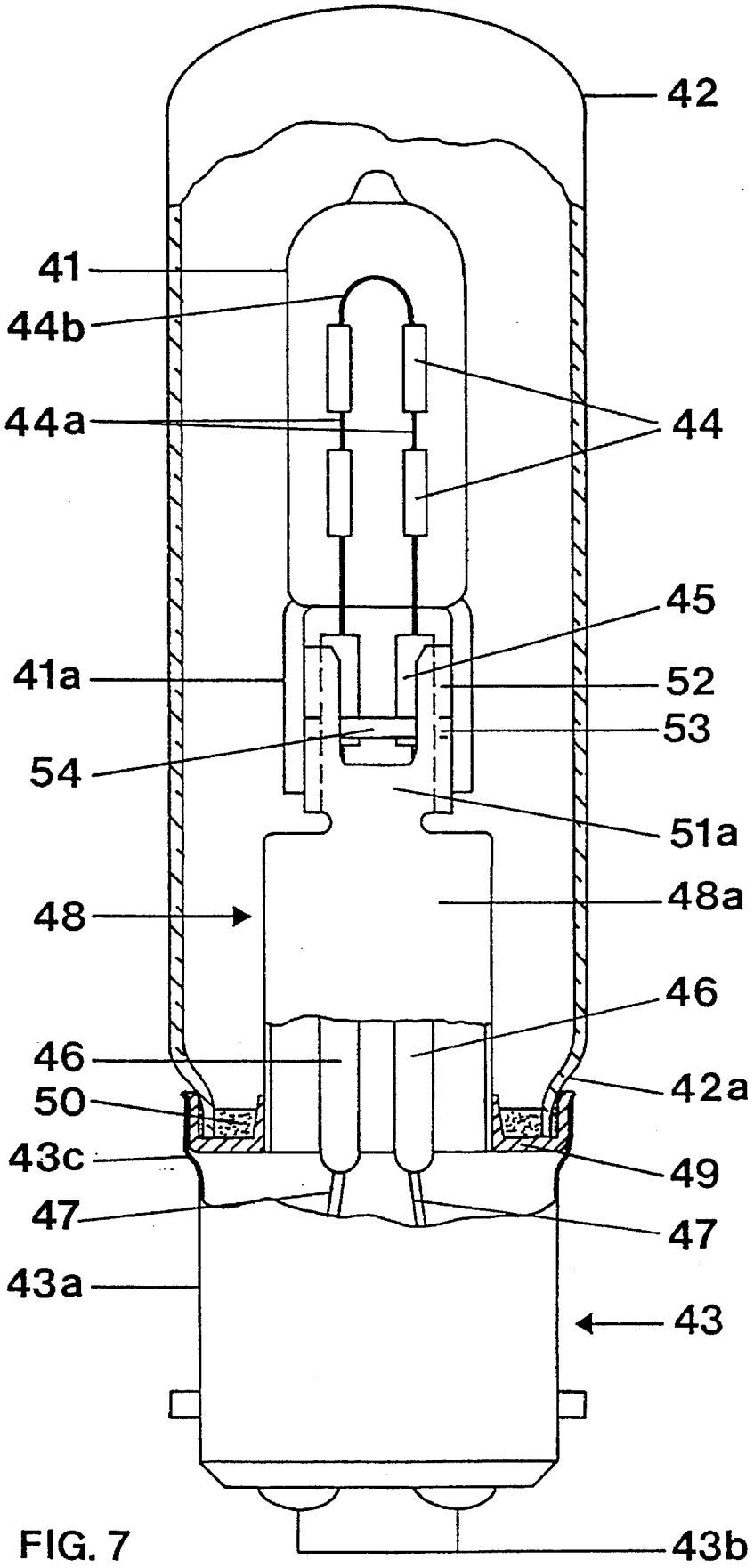

The bases may also be smoothly cylindrical, that is, not threaded. The retention tabs, for example tabs 28 (FIGS. 6*a*, 6*b*) can then be located as desired, for example in horizontal alignment or staggered. They will dig into the wall of the base and, if inclined as shown in FIG. 6*a*, prevent relative rotation as well as removal of the carrier 25 and the attached halogen lamp unit from the base. FIG. 7 illustrates a base having a smooth cylindrical wall, that is, a lamp with a bayonet base.

The lamp of FIG. 7 has a single-ended high-voltage halogen incandescent lamp unit. The lamp bulb 41 is made of quartz glass, located axially within a light transparent cylindrical outer bulb 42. The outer bulb 42 is formed with a slightly constricted neck region 42*a* at the lower, open end thereof. The neck region 42*a* is connected to a base sleeve 43*a* of a B22d bayonet base 43 by a suitable cement 50. An incandescent filament 44, formed of a plurality of electrically conductively connected coiled filament portions 44, connected by connecting portions 44*a*, 44*b* is located within the bulb 41. The filament portions 44, 44*a*, 44*b* can be retained within the bulb 41 in any suitable manner, for example as described in detail in the referenced U.S. Pat. No. 5,146,134, Stark et al, the disclosure of which is hereby incorporated by reference. The pinch seal 41*a* has a shallow double T or I shaped profile. Two current supply leads, not visible in FIG. 7, extend from the pinch seal. The current supply leads are connected to molybdenum foils 45 which, in turn, are electrically connected to the filament portions 44, 44*a*. The two current supply leads, not visible in FIG. 7, are connected as well known in any suitable manner with respective fuse elements 46 which, in turn, are connected by connecting leads 47 to button terminals 43*b* at the bottom of the base 43.

The halogen incandescent lamp is held in position by carrier 48, which engages around the pinch seal 41*a* of the halogen incandescent lamp unit. The carrier 48 is made of nickel-plated sheet metal, having a thickness of about 0.4 mm. It has a tubular lower portion 48*a*. The lower portion 48*a* engages a trough-shaped spacer ring 49, in which the opening of the trough faces the end portion 42*a* of the bulb 42. This end portion 42*a* is seated in the trough 49. The upwardly bent outer portion of the trough ring 49 is seated on shoulder 43 of base 43. It is securely connected to the base 43, for example being welded thereto if the elements are both of metal. The slightly constricted or narrow neck region 42*a* of the outer bulb 42 engages the bottom of the trough ring 49, and is secured thereto by customarily used, suitable cement 50. Alternatively the trough ring 49 can be formed as an element of the base sleeve 43*a*.

Two holder elements 51*a*, 51*b* (FIG. 8) integral with the tubular lower portion 48*a* of the lamp carrier hold the pinch seal 41*a* of the halogen unit. Only one of the holder elements 51*a* is visible in FIG. 7; the other holder element 51*b* (FIG. 8*b*) is identical to holder element 51*a* and is behind the holder element 51*a*. Each one of the holder elements 51*a*, 51*b* has inwardly directed, bent-over holding portions or jaws 52. The pinch seal 1*a* of the halogen incandescent lamp unit is held in position between the holder portions 51*a*, 51*b*. The inwardly directed attachment tabs or portions 52 engage against the broad sides of the pinch seal 41*a*, to clamp the pinch seal tightly therebetween. The tabs or portions 52 are formed with notches 53, with which a rib 54 on the pinch seal 41*a* interengages. The halogen incandescent lamp thus is reliably secured with respect to all directions, including axial direction. The holder portions 51*a*, 51*b* so engage with the double T or I shape of the pinch seal 41 that the halogen incandescent lamp unit is reliably axially retained within the outer bulb 42.

Figure 8A:
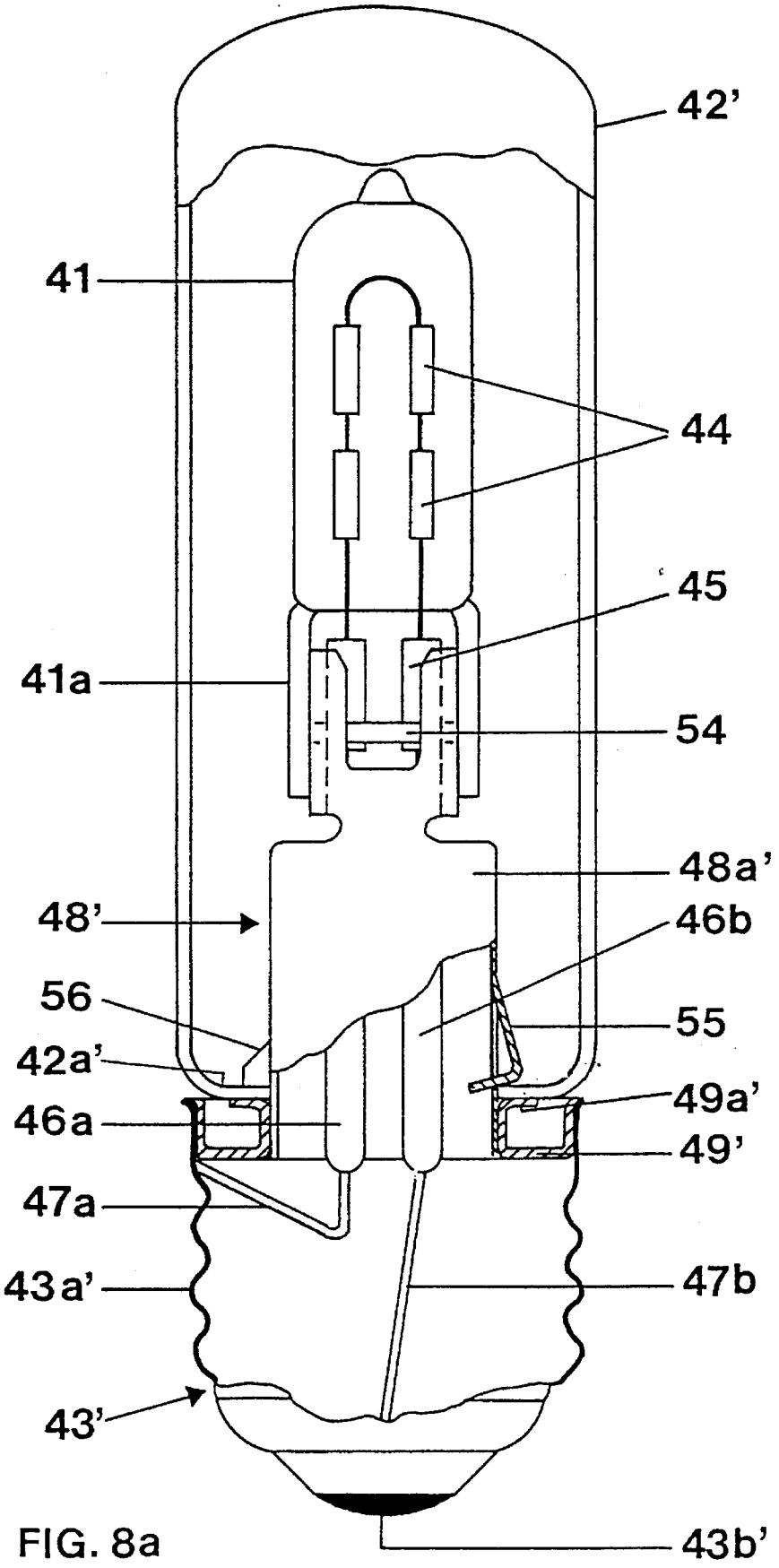
Figure 8B:
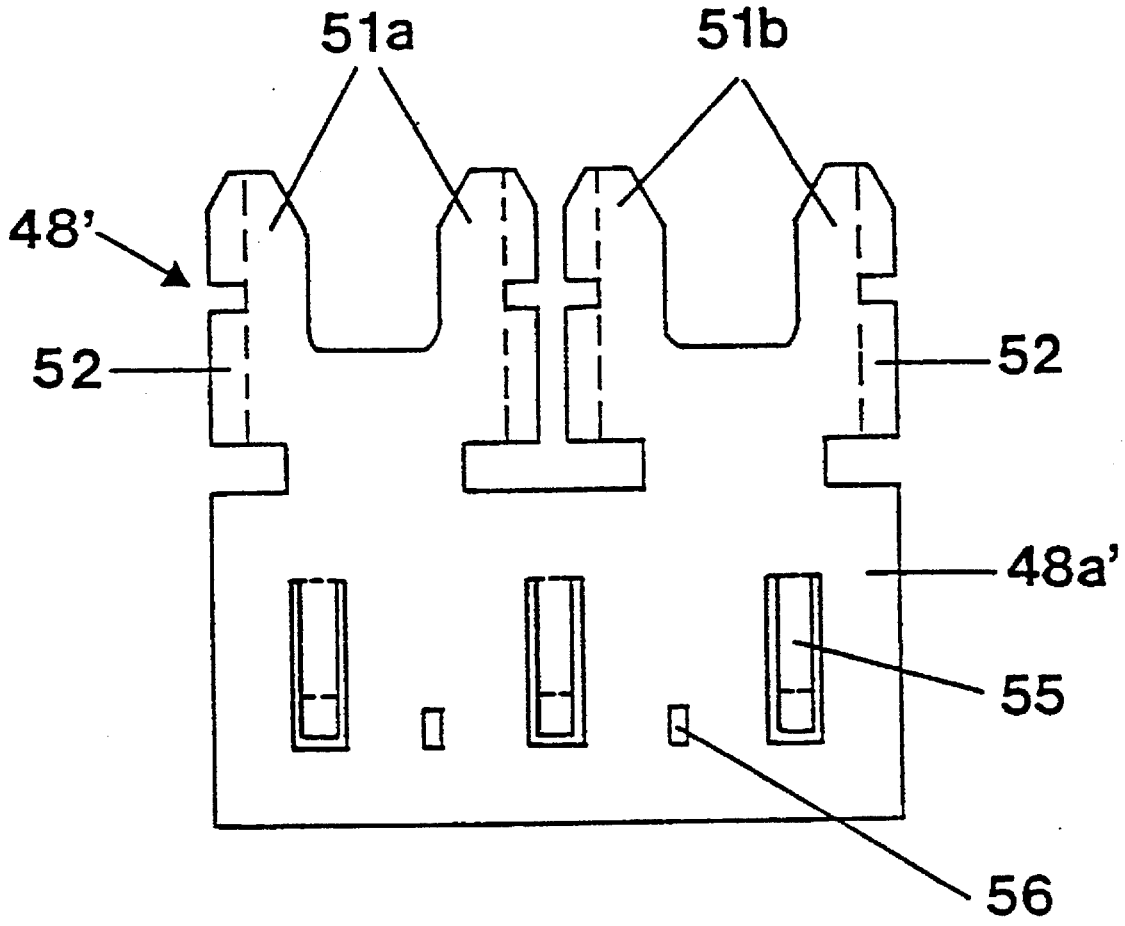

FIG. 8 illustrates another embodiment of the lamp in accordance with the present invention; in general, this embodiment is similar to that described in connection with FIG. 7, and similar reference numerals have been used, where appropriate, with additional prime notations. The difference between the embodiments of FIGS. 7 and 8*a*, 8*b* basically relates to the construction of the base, of the lamp carrier, as well as to the shape of the open end 42*a'* of the outer bulb 42'.

The base 43' is an E27 screw-in base. One of the current supply leads extending from the pinch seal 41a is connected, via fuse 46*a* and connecting wire 47*a*, with the base sleeve 43*a'*, which is of metal, to form an electrical connection. The other current supply lead 47*b* is connected through a melt fuse 46*b* to the base terminal 43*b'* of the base 43'.

The halogen incandescent lamp unit is identical to that of the embodiment described in connection with FIG. 7. It is retained by a carrier 48'. The carrier 48' is formed of a punched sheet-metal element, of a thickness of about 0.4 mm. It has a tubular bottom portion 48*a'*(see FIG. 8*b*) to which the two holding portions 51*a*, 51*b* are unitarily connected, by being formed thereon, that is, by punching out a single sheet-metal strip in the shape shown, for example, in FIG. 8*b*. The holding portions 51*a*, 51*b* retain the pinch seal 41*a* of the halogen incandescent lamp in position. The holding portions 51*a*, 51*b* are identical to those described in connection with FIG. 7. The base portion 48*a'* of the lamp carrier 48' engages in the spacer ring 49' and is welded thereto The spacer ring 49' again has a trough-shaped cross section, and is welded to the interior of the base sleeve 43*a'*. The spacer sleeve 49' is formed with a horizontally extending engagement surface 49*a'*, on which the outer bulb 42' can seat.

The construction of FIG. 8 is a cementless construction, that is, the outer bulb 42' is secured to the base 43' without cement. To attach the outer bulb 42' to the base 43', the lower portion 48*a'* of the lamp carrier 48' is formed with six resiliently inwardly deflectable, but normally outwardly projecting spring elements 55 (see FIGS. 8*a*, 8*b*), uniformly spaced along the circumference of the lower portion 48*a'*. Only three of these spring elements are shown in FIG. 8*b*, for clarity. The spring elements 55 normally extend from the jacket surface of the lower portion 48*a'*. The interior diameter of the outer bulb 42' in the neck portion 43*a'* is only slightly larger than the diameter of the lower portion 48*a'* of the carrier. When fitting the outer bulb 42' over the assembly of base 43' and the halogen lamp unit already held in position by the carrier 48', the neck portion 42*a'* of the bulb 42' deflects the spring elements 55 radially inwardly and then permits the spring element to snap over the inwardly extending projection 42*a'* of the neck portion, which seats on the engagement surface 49*a'* of the trough ring 49'. The spring elements 55 then provide for cementless coupling between the outer bulb 42' and the base 43'. A projection-and-recess arrangement prevents relative rotation of the outer bulb 42' with respect to the base 43'. In the example shown, the lower portion 48*a'* of the lamp carrier 48' is formed with two projections 56. In the region of the opening of the neck portion of the outer bulb, the inwardly extending portion 42*a'* is formed with two notches, fitting on the projections 56. This interengagement of projections and recesses prevents rotation of the outer bulb 42' about its axis.

Projection-and-recess arrangements can also be formed on the spacer ring 49', for example on the engagement surface 49*a'* in conjunction with the neck portion 42*a'* of the bulb 42'.

Various changes and modifications may be made, and the invention is not limited to the examples and embodiments described. A different type of base may be used; for example, instead of an E14 base an E27 base or any other kind of screw-in base may be used. It is only necessary to change the dimensions of the tubular lower portion of the lamp support element to the dimensions of the base sleeve.

Various other changes and modifications may be made, and any features described herein may be used with any of the others, within the scope of the inventive concept.

We claim:

1. A single-based halogen incandescent lamp adapted for use with a general service incandescent lamp socket comprising a light-transmissive outer envelope (2, 42, 42');

a base (3, 43, 43') connected to the outer envelope, said base being adapted for insertion in said socket, and having a tubular metallic base sleeve (3*a*, 43*a*, 43*a'*) extending longitudinally of said base;

a halogen incandescent lamp (1, 20, 41) located within the outer envelope, said halogen incandescent lamp having a projecting end portion (1*a*, 20*a*, 41*a*) at an end thereof, which end portion is proximate to said base;

current supply leads (6*a*, 6*b*, 21, 22, 47, 47*a*, 47*b*) extending from the halogen incandescent lamp, at least one of said leads being electrically connected to a terminal (3*b* 43*b*, 43*b'*) on said base;

means for retaining said halogen incandescent lamp (1, 20, 41) in position in said outer envelope (2, 42, 42') comprising a punched sheet-metal element (5, 5', 5", 25, 48, 48') clamped around said projecting end portion (1*a*, 20*a*, 41*a*) and being mechanically secured to an upper wall portion of said base sleeve (3*a*, 43*a*, 43*a'*) of the base (3, 43, 43') and at least partly located therein; and wherein said punched sheet-metal element (5, 5', 5", 25, 48, 48') has an essentially tubular portion (5*a*, 5*a'*, 5*a"*, 25*a*, 48*a*, 48*a'*) engaging within the interior of the metallic base sleeve (3*a*, 43*a*, 43*a'*) and fitted against and engaging the wall of said metallic base sleeve.

2. The lamp of claim 1, wherein said halogen incandescent lamp has a lamp bulb (1, 20, 41) terminating in at least one pinch end (1*a*, 20*a*, 41*a*), forming said projecting end portion of the halogen incandescent lamp, and said pinch end is clamped and retained in said punched sheet-metal element.

3. The lamp of claim 1, wherein said punched sheet-metal element (5, 5', 24, 48, 48') has an upper portion forming two holding jaws (5*b*, 5*c*; 5*b'*, 5*c'*, 25*b*, 51*a*, 51*b*, 52), said holding jaws being clamped around said projecting end portion of the halogen incandescent lamp bulb.

4. The lamp of claim 3, wherein said projecting end portion (1*a*, 20*a*, 42*a*, 42*a'*) of the halogen incandescent lamp is formed as a pinch or press seal with one or more projections, optionally ribs (10, 54), extending essentially transversely to an axis of the lamp; and wherein the holding jaws (5*b*, 5*c*; 5*b'*, 5*c'*, 52) are formed with notches (9, 9', 48) engaging around said projections (10).

5. The lamp of claim 1, wherein said essentially tubular portion (5*a"*, 25*a*) includes projecting apron elements (13, 25*b*) unitary with said essentially tubular portion (5*a"*, 25*a*), said apron elements being formed with inwardly directed, with respect to an axis of the lamp, attachment tabs or flaps (14, 27), said attachment tabs or flaps clampingly surrounding the projecting end portion (1*a*, 20*a*) of the bulb (1, 20) of the halogen incandescent lamp.

6. The lamp of claim 5, wherein said projecting end portion (1*a*, 20*a*, 42, 42*a*) of the halogen incandescent lamp is formed as a pinch or press seal with one or more projections, optionally ribs (10, 54), extending essentially transversely to an axis of the lamp; and wherein the clamping tabs or flaps (14, 27) are formed with notches (9") surrounding and engaging around said projections (10).

7. The lamp of claim 1, wherein the base sleeve (43*a*) is essentially cylindrical and smooth; and wherein the tubular portion of said punched sheet-metal element (48) is secured to said base sleeve (43*a*).

8. The lamp of claim 1, wherein the base sleeve (3*a*, 43*a*) is formed with locating means (3*c*, 43*c*) at a predetermined axial location with respect to the longitudinal extent of said base (3, 43); and wherein said punched sheet-metal element (5, 48) includes positioning means (11, 11', 11", 11''', 49, 49') engageable with said locating means to position said punched sheet-metal element in predetermined location with respect to said base.

9. The lamp of claim 1, wherein said essentially tubular shaped portion (5*a*) is formed with retention projections (5*d*, 5*d'*) located thereon and projecting toward the interior of said base sleeve (3*a*, 43*a*) and having a sharp edge or point to dig into the inner surface of said base sleeve.

10. The lamp of claim 1, wherein the base sleeve (3*a*) has an inner screw thread;

and wherein said punched sheet-metal element (5, 5', 5", 25) has an essentially tubular portion (5*a*), screwed into and retained in said inner thread of the base sleeve (3*a*).

11. The lamp of claim 10, including retention projections comprising a plurality of projecting tips or bumps (5*d*) projecting externally from said tubular portion (5*a*) arranged on said tubular portion of the punched sheet-metal element, axially staggered in form of a theoretical interrupted flank of a thread, said retention projections (5*d*) engaging the inner thread of the base sleeve (3*a*).

12. The lamp of claim 11, wherein said projecting tips or bumps are rounded in screw-in direction and formed with end portions which, in the opposite direction, have a sharp edge.

13. The lamp of claim 10 including retention projections which comprise tabs (5*d'*, 28) externally projecting from the essentially tubular portion, and located at an inclination corresponding approximately to a flank of the inner thread of the base sleeve, said tabs being radially outwardly spread and gripping and engaging against the inner wall of the base sleeve (3*a*, 43*a'*).

14. The lamp of claim 13, wherein the free ends of the tabs (5*d'*, 28) are inclined in screwing-in direction of the inner thread.

15. The lamp of claim 1, wherein the metallic base sleeve (3*a*, 43*a*) is formed with a locating shoulder (3*c*); and wherein said punched sheet-metal element is formed with at least one externally projecting locating tab (11, 11', 11", 11''', 29) engaging said locating shoulder (3*c*) on the base sleeve (3*a*).

16. The lamp of claim 15, wherein said base sleeve is of metal and said tab (11, 11', 11", 11''', 29) and locating shoulder (3*c*) are welded together.

17. The lamp of claim 1, wherein the halogen incandescent lamp is a tubular lamp having, with respect to the base (3), a proximate pinch seal (1*a*) and a distal pinch seal (1*b*);

said current supply leads (6*a*, 6*b*) extending from said pinch seals;

a current connection (8) extending from the current supply lead (6*b*) of the distal pinch seal (1*b*), and electrically connected to the punched sheet-metal element; and wherein the current supply lead (6*a*) which extends from the proximate pinch seal (1*a*) is connected to a central terminal (3*b*) of the base (3).

18. The lamp of claim 1, wherein the halogen incandescent lamp is a single-ended high-voltage halogen incandescent lamp having a single pinch seal (20) closing off the bulb of the halogen incandescent lamp;

two current supply leads (21, 22) extending from said pinch seal; and wherein at least one of the current supply leads (22) which extends from the single pinch seal (20) is electrically connected to the terminal (3*b*, 43*b*) of the base (3).

19. The lamp of claim 1, wherein said base sleeve (43) is smooth;

said base having at least one external terminal, and at least one of said current supply leads is electrically connected to the at least one terminal.

20. The lamp of claim 1, wherein said base sleeve includes a trough-shaped end portion (49, 49*a*);

said light-transmissive outer envelope (42, 42') is formed with an open neck portion (42*a*), said open neck portion being seated on and retained in said trough-shaped end portion.

21. The lamp of claim 20, wherein said light-transmissive outer envelope (42, 42') has an inwardly extending rim or bead (42*a'*);

and resilient holding strips (55) are provided on said punched sheet-metal element (48') projecting outwardly therefrom, with respect to an axis of the lamp, being snapped over, and engaging said rim or bead.

22. The lamp of claim 1, wherein,said light-transmissive outer envelope (2, 42, 42')is retained in position in said base (3, 43, 43', 49) by a glass-to-metal cement (50), and bonded by said cement to said base.

23. The lamp of claim 1, wherein the metallic base sleeve (3*a*) comprises an Edison base.

24. The lamp of claim 1, wherein the metallic base sleeve (43) comprises a bayonet base.

* * * * *